US005266220A

United States Patent [19]

Hammond et al.

[11] Patent Number: 5,266,220

[45] Date of Patent: Nov. 30, 1993

[54] METHOD FOR MELTING CONTAMINATED SNOW AND WASHING SOLIDS HELD THEREIN

[75] Inventors: Patrick E. Hammond, 1013 E. Dimond #146, Anchorage, Ak. 99515; Patrick L. Severin, Skagit County; William C. Drake, Gray's Harbor County, both of Wash.

[73] Assignee: Patrick E. Hammond, Anchorage, Ak.

[21] Appl. No.: 778,731

[22] Filed: Oct. 16, 1991

[51] Int. Cl.[5] ..... B01D 11/02

[52] U.S. Cl. ..... 210/768; 210/773; 210/803; 135/25.1; 126/343.5 R

[58] Field of Search ..... 210/176, 178, 179, 187, 210/768, 772–775, 803, 804; 37/227, 228; 126/343.5 R, 343.5 A; 134/25.1, 40, 34

[56] References Cited

U.S. PATENT DOCUMENTS

| | | | |
|---|---|---|---|
| 634,021 | 10/1899 | Palmer | 126/343.5 R |
| 818,072 | 4/1906 | Blake | 126/343.5 R |
| 2,592,267 | 4/1952 | Gangemi et al. | 126/343.5 R |
| 2,991,784 | 7/1961 | Canzano | 126/343.5 R |
| 3,171,405 | 3/1965 | Miller | 126/343.5 R |
| 3,277,885 | 10/1966 | Gontcharuk | 126/343.5 R |
| 3,327,659 | 6/1967 | Nolan et al. | 126/343.5 R |
| 3,331,433 | 7/1967 | Hagberg | 37/228 |
| 3,803,732 | 4/1974 | Moreno | 126/343.5 R |
| 3,866,340 | 2/1975 | Krickovich | 126/343.5 R |
| 4,053,406 | 10/1977 | Deslauriers et al. | 210/774 |
| 4,288,931 | 9/1981 | Rhodes | 37/10 |
| 4,506,656 | 3/1985 | Baasch | 126/343.5 R |
| 4,785,561 | 11/1988 | Swanson | 37/228 |
| 5,056,541 | 10/1991 | Schade et al. | 210/772 |

FOREIGN PATENT DOCUMENTS

| | | | |
|---|---|---|---|
| 256613 | 10/1989 | Japan | 37/228 |
| 466 | of 1900 | United Kingdom . | |

*Primary Examiner*—Matthew O. Savage

*Attorney, Agent, or Firm*—Marger, Johnson, McCollom & Stolowitz

[57] ABSTRACT

A method for melting snow containing solids and chemical contaminants and washing the solids is disclosed therein. The method includes the steps of heating the snow mixture within a hopper to melt the snow into water, gravitationally separating the solids from the water, agitating the water and solids to wash and separate chemical contaminates from the solids, discharging the water/contaminant mixture from the hopper for further treatment, and discharging the decontaminated solids. A cleansing agent may be added during the washing step to facilitate separation of the chemical contaminants from the solids.

23 Claims, 9 Drawing Sheets

METHOD FOR MELTING CONTAMINATED SNOW AND WASHING SOLIDS HELD THEREIN

BACKGROUND OF THE INVENTION

The present invention relates to melting, separation and disposal of mixtures of snow, ice, and solids. The invention further relates to melting, separation, decontamination, and disposal of contaminated mixtures of snow, ice and solids.

Industrial Projects may be undertaken in areas such as northern Alaska which experience frequent snowfall and freezing temperatures. As a result of these climactic conditions, ice and snow accumulate in exposed work areas. As ice and snow accumulate, any gravel or other solid debris on the ground in the work areas is frozen into the mixture as well. These accumulations hamper safe and free movement of personnel and equipment around the work area. Safe and efficient operation of the industrial progress therefore requires timely and cost-effective removal of accumulated frozen mixtures of ice, snow and solids from work areas, which may be many acres in size.

The problem is further aggravated by periodic, accidental discharges of materials such as oils or solvents into the work area which may occur despite the best precautionary measures. Discharged contaminants then end up as part of the frozen mixture of ice, snow and gravel, and result in the entire frozen mixture becoming contaminated. In order to prevent contamination of the surrounding environment, the entire frozen mixture must then be handled according to environmental regulations governing isolation and disposal of contaminated materials. The regulations are demanding and strict. The cost of compliance is very high, and may have a significant impact on the economic viability of an industrial project. At this time cleanup is handled by inefficient warm water nesting tanks and costly hauling of contaminated snow to designated locations where the contaminated material still has to be cleaned at a later date.

Various types of snow and ice melting equipment are disclosed in U.S. Pat. Nos. 634,021, 2,592,267, 2,991,784, 3,171,405, 3,277,885, 3,803,732, 3,866,340 and 4,506,656. Each discloses equipment for melting collected snow and ice, and then discharging the melted snow as a liquid or a slurry. U.S. '340 and '372 additionally disclose means for collecting snow from the surface and conveying it to a container for melting.

British Pat. No. 466 to Smallwood discloses a snow melting apparatus which, in addition to means for melting snow and discharging the resulting liquid, discloses a door for removing accumulated "sludge, etc." from the apparatus.

U.S. Pat. No. 818,072 to Blake discloses a snow melting machine which employs one or more grinding wheels to melt snow and ice which has been deposited in a hopper. Means are also disclosed for diverting entrained "stones and other obstructions" from beneath the grindstone, and for immediately discharging the diverted stones from the apparatus.

However, the above cited patents do not disclose machines which separate and collect contaminants which may be present in the frozen mixture. Further, although the '072 and the '466 patents provide for the removal of stones and sludge, respectively, neither provides for containment of contaminants while discharging collected solids.

Therefore a need exists for an ice and snow melting apparatus which is capable of melting frozen mixtures of ice, snow and solids, particularly at extremely cold temperatures, which is further capable of separating solids from the mixture, and which is also capable of separating and isolating contaminants which may be present in the frozen mixture to provide an effluent solid streams which are environmentally acceptable for discharge back into the environment. Further, the apparatus must be capable of handling large volumes of frozen mixtures efficiently and quickly, and of operating reliably in the extremely low temperatures encountered in arctic regions.

SUMMARY OF THE INVENTION

An apparatus is provided for melting snow, snow which is mixed with solids, and snow which contains contaminants, which can operate in a frigid outdoor environment. The apparatus includes means for receiving snow, snow mixed with solids, and snow containing contaminants, means for heating the snow to a temperature for melting the snow into water, means for separating solids from the snow and from the water, and means for separating contaminants from the solids for producing substantially decontaminated solids. The outside air temperature in the frigid outdoor environment in which the apparatus can operate includes temperatures of not more than about −20° F., −30° F., and −40° F.

The apparatus includes means for discharging decontaminated solids from the apparatus, and may include means for discharging decontaminated solids while isolating the separated contaminants from the surrounding environment. The apparatus also includes means for discharging water from the apparatus while containing decontaminated solids within the apparatus. The apparatus may further include means for collecting the separated contaminants, discharging the collected contaminants, and discharging said contaminants while isolating said contaminants from a surrounding environment.

The apparatus may include means for moving said apparatus to a plurality of locations within a surrounding environment.

The apparatus includes heating means for melting said snow into water which may include a pipe within said receiving means, and a heated fluid within the pipe. The heating means may also include one or more walls which may also serve to contain the snow and water, and may further include an enclosed passageway within each wall. Where the heating means includes more than one wall, the passageways within each wall may be interconnected to provide a continuous passageway. The heating means may further include a heated fluid within the passageway(s) for heating the snow indirectly through the wall(s). The fluid may be heated to a predetermined temperature of 350°, 400°, or 500° F. for heating and melting the snow.

A method is also provided for conducting a snow melting operation for melting snow, snow mixed with solids, and snow which contains contaminants, which can operate in a frigid outdoor environment comprising the steps of providing means in said environment for receiving said snow, snow mixed with solids, and snow which contains contaminants, providing means in said environment for heating said snow for melting said snow into water, providing means in said environment for separating said solids from said snow and from said water, introducing said snow, snow mixed with solids and snow which contains contaminants into said receiving means, heating said received snow and solids, thereby melting said snow and forming water, separating said contaminants from said solids thereby producing substantially decontaminated solids. The outside air temperature in which the snow melting operation can be conducted may be not more than about −20°, −30°, or −40° F.

The step of providing heating means for melting the snow may include providing a pipe within the receiving means, and may further include providing a heated fluid within the pipe. The step of providing snow heating means may include providing one or more walls, which may also serve to receive and contain the snow and water, and may further include providing means defining an enclosed passageway within one or more of the walls. Where more than one wall having an enclosed passageway is provided, the method may also include providing means for interconnecting one or more of the enclosed passageways to provide a continuous passageway between one or more of the walls. The method may also include providing a heated fluid for indirectly heating the snow, and the heated fluid may provided within one or more enclosed of the enclosed passageways, if provided, for transferring heat through a wall to the snow. In either case, the fluid may be heated to a predetermined temperature, which may be about 350°, preferably about 400°, and more preferably about 500° F. The method may include heating the melted snow to a temperature of at least about 50° F., preferably at least about 60° F., and more preferably at least about 70° F.

The method may include the step of discharging decontaminated solids, or discharging decontaminated solids while isolating said contaminants from a surrounding environment.

The method may include the step of discharging water, which may be discharged for further decontamination, or discharging water while isolating contaminants from a surrounding environment.

The method may include the steps of collecting separated contaminants or discharging separated contaminants, preferably while isolating the contaminants from the surrounding environment.

The method may include moving the receiving means, heating means, and separating means to a plurality of locations within the surrounding environment.

The method may be conducted in a frigid environment where the air temperature is not more than about −20° F., preferably not more than about −30° F., and more preferably not more than −40° F.

The method may be conducted to melt at least 100, preferably at least 150, and more preferably at least 200 cubic yards of snow per hour at an ambient temperature of not more than −40° F.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
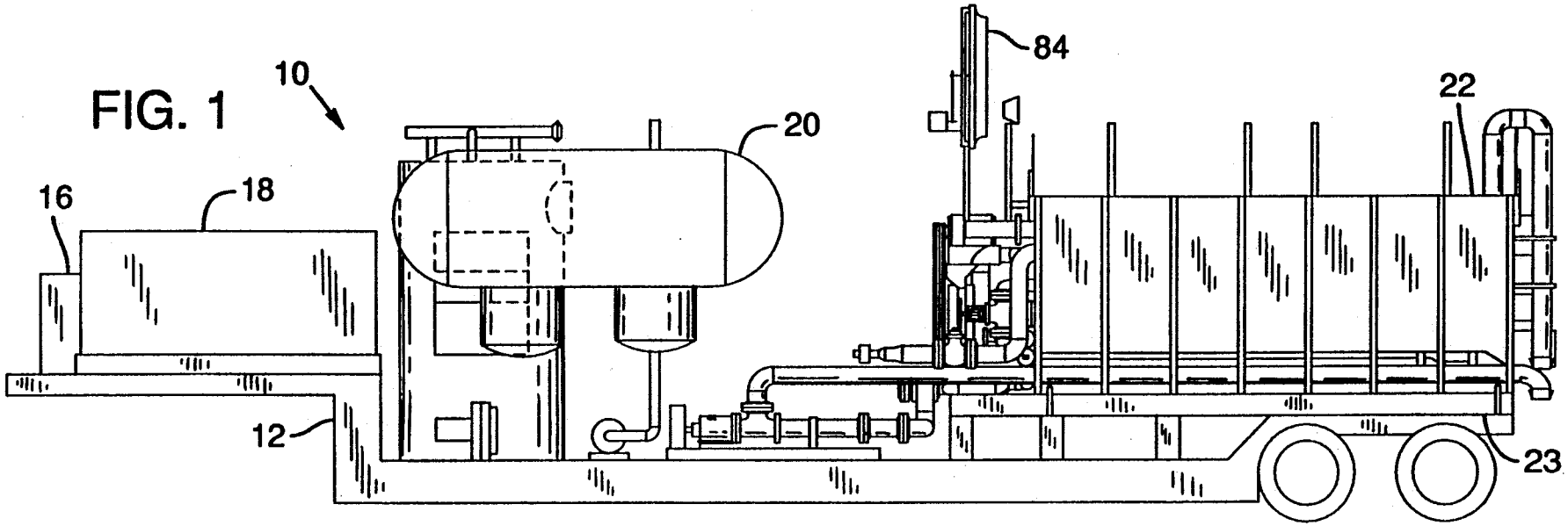
FIG. 1 shows a side schematic view of an apparatus for melting snow and separating contained solids according to the present invention.
Figure 2:
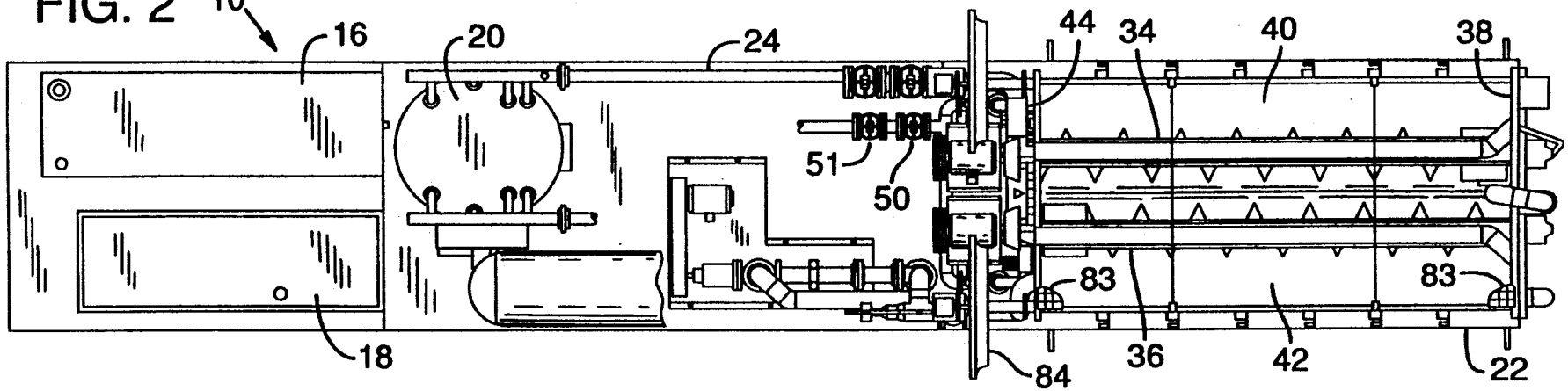
FIG. 2 shows a plan schematic view of an apparatus for melting snow and separating contained solids according to the present invention.

Referring to FIGS. 1 and 2, a system 10 is depicted for melting snow, snow mixed with solids, and snow which contains contaminants. This system 10 is mounted on a flatbed trailer 12, such as a single drop trailer, so that it can readily moved from site to site for conducting the snow removal operations. System 10 can have a sheet metal cover (not shown) over certain parts thereof such as over the boiler 20. In any case, the trailer 12 can be pulled to a given removal site by a truck (not shown), such as a conventional tandem axle truck. The system 10 has been designed and engineered to operate efficiently at temperatures as low as −40° F. When outside ambient temperatures are above −40° F., the melting capacity of system 10 will significantly increase and fuel consumption will significantly decrease. The system 10 is designed to provide a melting capacity of at least about 100 cubic yards, preferably about 170 cubic yards, preferably at least about 200 cubic yards, and most preferably at least about 250 cubic yards of snow per hour. The actual production rate depends to a great extent on ambient conditions.

The system 10 comprises a fuel reservoir 16, a generator 18, a boiler 20, a hopper 22, and the required piping and auxiliary systems as hereinafter discussed. The snow melting, separating and discharging operations are conducted in hopper 22 which includes an internal material heating, cleaning, mixing and transporting system as hereinafter described. Hopper 22 is supported by hopper frame support 23 (see also FIG. 4).

Diesel fuel used to power generator 18 is stored in fuel reservoir 16, a conventional metal tank insulated and heated to accommodate extreme temperature conditions. Generator 18 is a Caterpillar 3404 Package Generator Set, rated 180 EKW @ 1800 RPM, 60 HZ, and 3 Phase.

Boiler 20 is preferably a thermal fluid boiler such as the Model FT-C0600 Thermopac thermal fluid system manufactured by Fulton Thermal Corporation of Pulaski, N. Y. Boiler 20 has a rated capacity of 6 million BTU's, a maximum fluid temperature of 600° F., and a maximum fluid flow rate of 330 gallons per minute. Heated thermal fluid typically exits boiler 20 at approximately 500° F. The heated thermal fluid (not shown) is delivered to numerous areas of the hopper through a system of pipes and valves as discussed below.

Paratherm NF fluid, which is composed of white mineral oil, is the thermal fluid of choice. This fluid is completely non-toxic, and is certified by the FDA and USDA for use with food and pharmaceuticals. The thermal fluid used is environmentally acceptable in the event that there is spillage.

Figure 3:
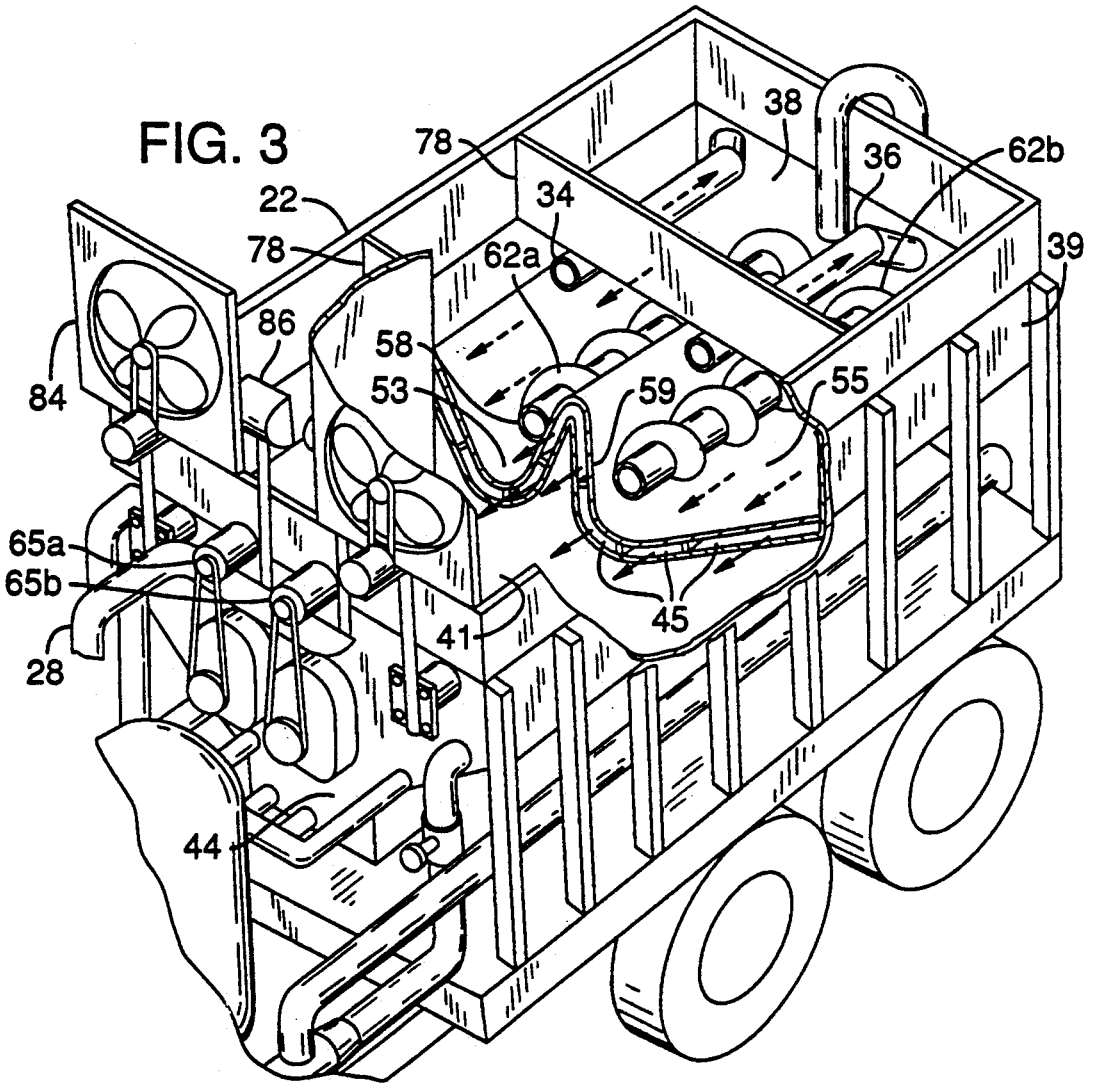
FIG. 3 is a perspective, partial cutaway view of the melting hopper.
Figure 4:
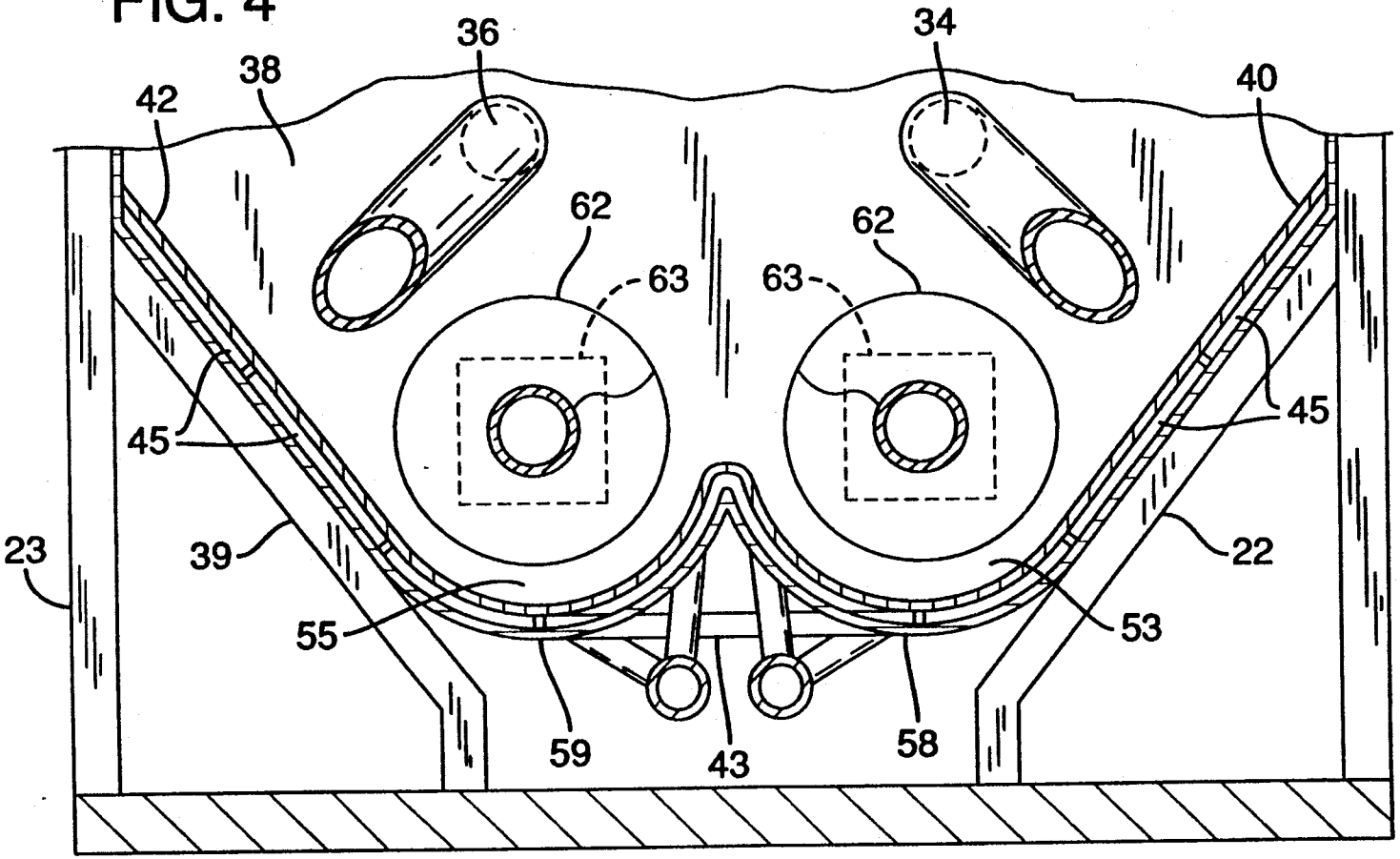
FIG. 4 is an rear end sectional view of the melting hopper.

As best seen in FIGS. 3 and 4, hopper 22 includes front wall 44, rear wall 38, outer side walls 39, sloped inner side walls 40 and 42, front bottom was 41, rear bottom wall 43, and left and right trough walls 58 and 59 respectively. Outer side walls 39 and sloped inner side walls 40 and 42 are joined to front wall 44 and rear wall 38. Trough walls 58 and 59 are joined at their front and rear edges to front and rear bottom walls 41 and 43 respectively, and are joined at their lower lateral edges to the lower edges of sloped side walls 40 and 42. Trough walls 58 and 59 are joined together at their upper inner lateral edges, thereby defining parallel left and right longitudinal troughs 53 and 55 respectively. Troughs 53 and 55 do not extend to meet front wall 44 and rear wall 38, but terminate where they are joined to front and rear bottom walls 41 and 43. Front and rear bottom walls 41 and 43 extend laterally to join the lower front and rear lateral edges respectively of sloped inner side walls 40 and 42, completing the bottom of hopper 22.

Front wall 44, rear wall 38, outer side walls 39, sloped inner side walls 40 and 42,, and left and right trough walls 58 and 59 have inner passages 45 through which heated thermal oil flows. The inner passages 45 of front wall 44, rear wall 38, sloped inner side walls 40 and 42 are interconnected to allow heated oil to flow through rear wall 38, into side walls 40 and 42, and forward into front wall 44. The heated walls of hopper 22 and troughs 53 and 55 serve to melt the snow mixture initially placed in hopper 22, and heat the resulting slurry in hopper 22 during normal operation as described below.

Figure 5:
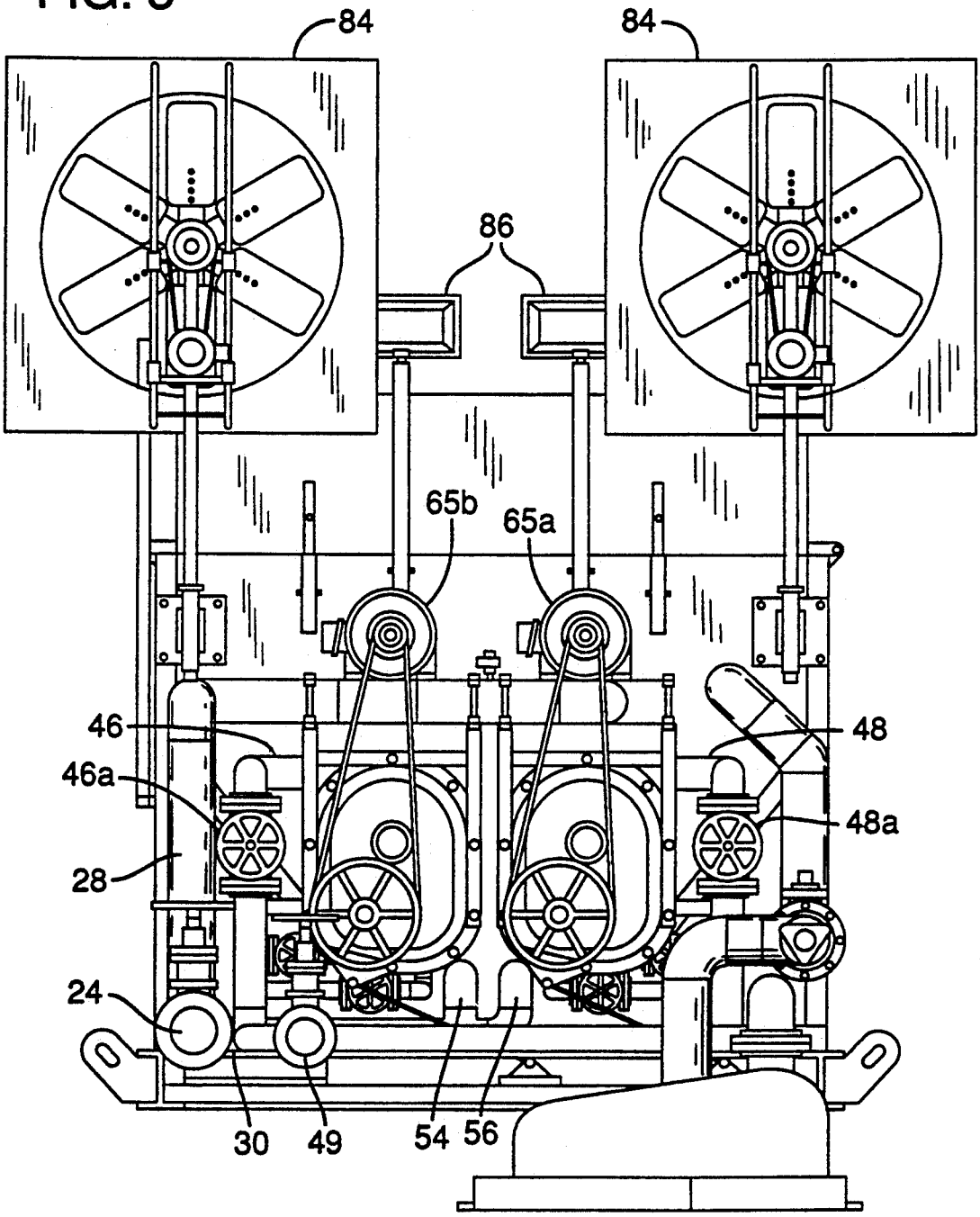
FIG. 5 is a front end view of the melting hopper.
Figure 6:
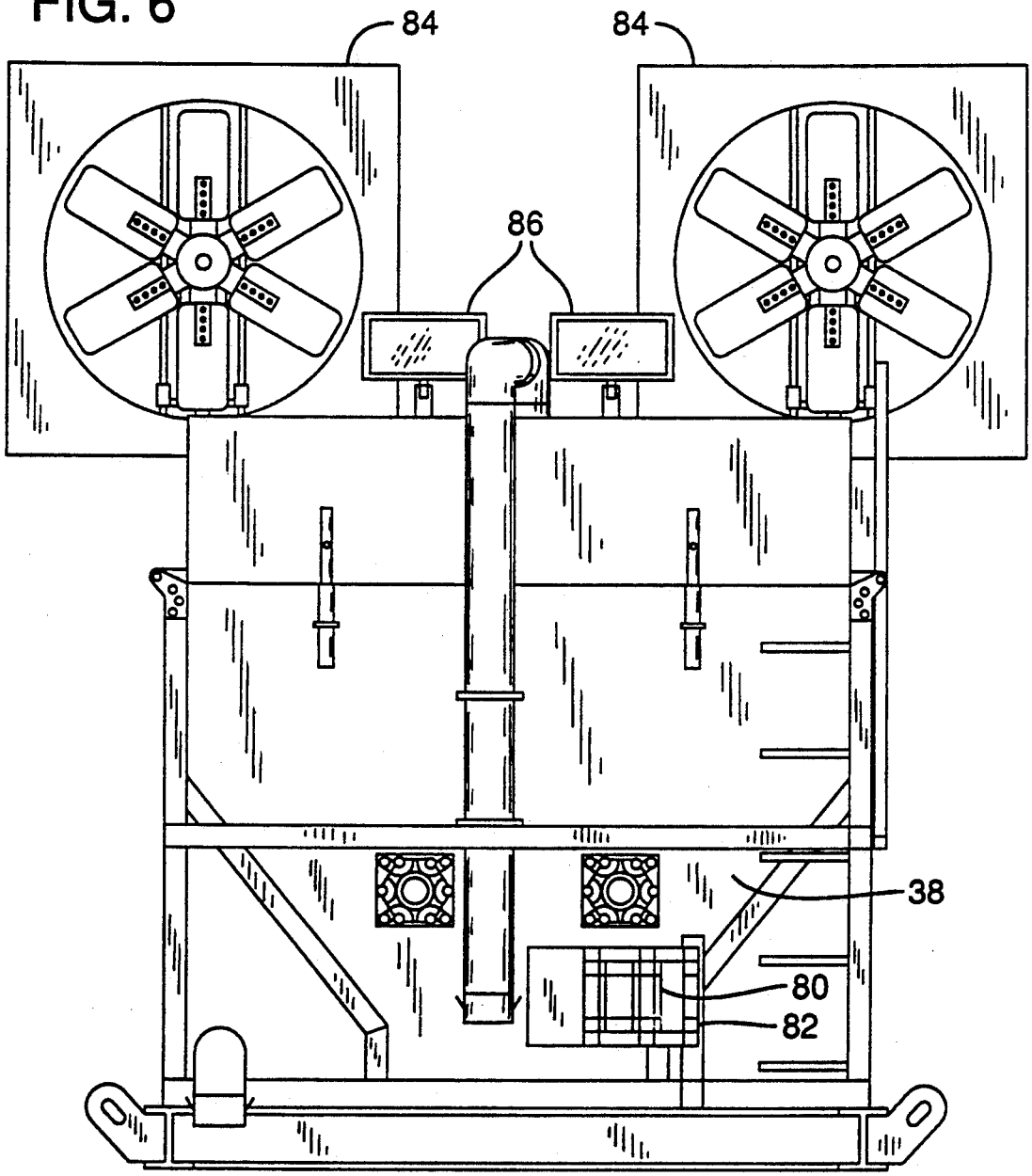
FIG. 6 is a rear end view of the melting hopper.

Located in the trough-like portions of hopper 22 are left auger 62*a* and right auger 62*b*. Augers 62*a* and 62*b* are each a 20" diameter screw conveyor, which are disposed generally parallel to each other. Augers 62*a* and 62*b* are supported at each end by thrust bearings 63. Augers 62*a* and 62*b* are each separately rotated by electric motor and sheave assemblies 65*a* and 65*b* (FIG. 5). Augers 62*a* and 62*b* have oppositely directed threads, and are rotated so that right auger 62*b* moves solids toward the front of hopper 22 and auger 62*a* moves solids towards the rear of hopper 22. Solids in hopper 22 are thereby circulated in a clockwise pattern in the bottom portion of hopper 22. In addition, augers 62*a* and 62*b* serve to agitate the snow, water and solid slurry for cleansing the solids, then to deliver cleansed solids to the rear hopper 22 for discharge through water tight tail end gate 80. Circulation of the slurry within hopper 22 by augers 62*a* and 62*b* also enhances the transfer of heat through the walls of the hopper 22 and troughs 53 and 55.

Hopper 22 is fitted with lateral baffles 78 above sloped sides walls 40 and 42. Baffles 78 reduce churning during the melting operation, and particularly if trailer 12 is moved while slurry remains in hopper 22. Hopper 22 is covered by a material screen 83 to reject over sized solids which could jam augers 62, and which also serves to break up larger masses of snow and solids into smaller pieces for more rapid melting.

As best seen in FIG. 5, mounted on hopper 22 are fan assemblies 84 and light assemblies 86 to facilitate operation in varying conditions of light and weather., and for clearing steam generated during operation from above hopper 22.

Returning to FIGS. 1 and 2, in operation system 10 is moved to the desired site on a flatbed trailer 12 pulled by a truck 14. The generator 18 is started (in transit, or upon arrival) to provide electrical power to system 10. Boiler 20 then heats the thermal fluid to a predetermined temperature. Once the thermal fluid is heated, the snow melting operation can begin.

Referring to FIGS. 1 through 9, the heated thermal fluid flows from boiler 20 through a 6" supply pipe 24. At point 26 the flow is split into upper supply pipe 28 and lower supply pipe 30. The portion of the heated thermal fluid directed into upper supply pipe 28 flows to point 32 where it enters 6" upper hopper heating pipes 34 and 36, which carry the thermal fluid into inner passage of rear wall 38. The fluid then flows into interconnected inner passages 45 of sloped sides 40 and 42, and forward into inner passages 45 of front wall 44. The fluid then exits front wall 44 through 4" return pipes 46 and 48, and flows through globe valves 46*a* and 48*a*. Return pipes 46 and 48 merge at point 47 into return line 49 (FIG. 5). The thermal fluid flows through return line 49 and globe valves 50 and 51 to the boiler 20 for reheating and recirculating.

Figure 7:
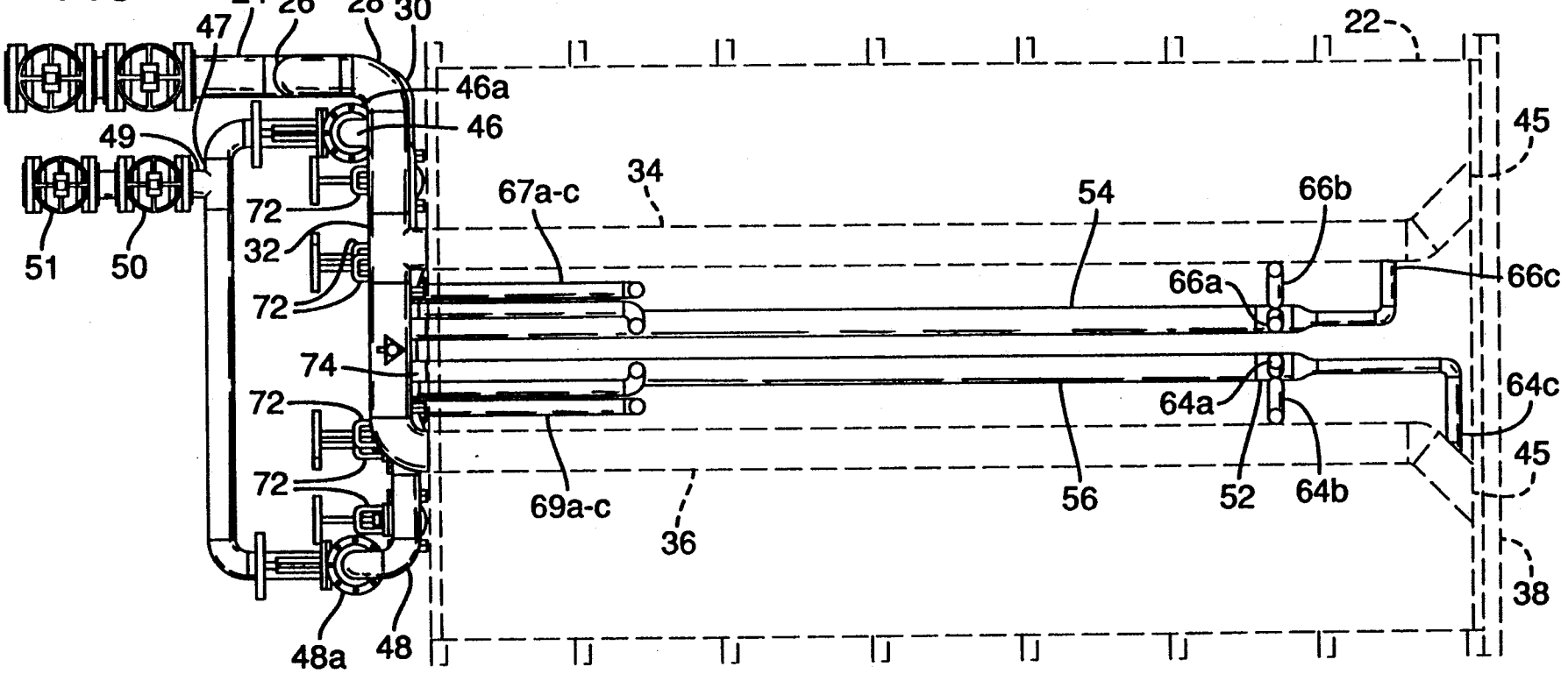
FIG. 7 is a schematic plan view of the thermal fluid supply and return piping system.
Figure 8:
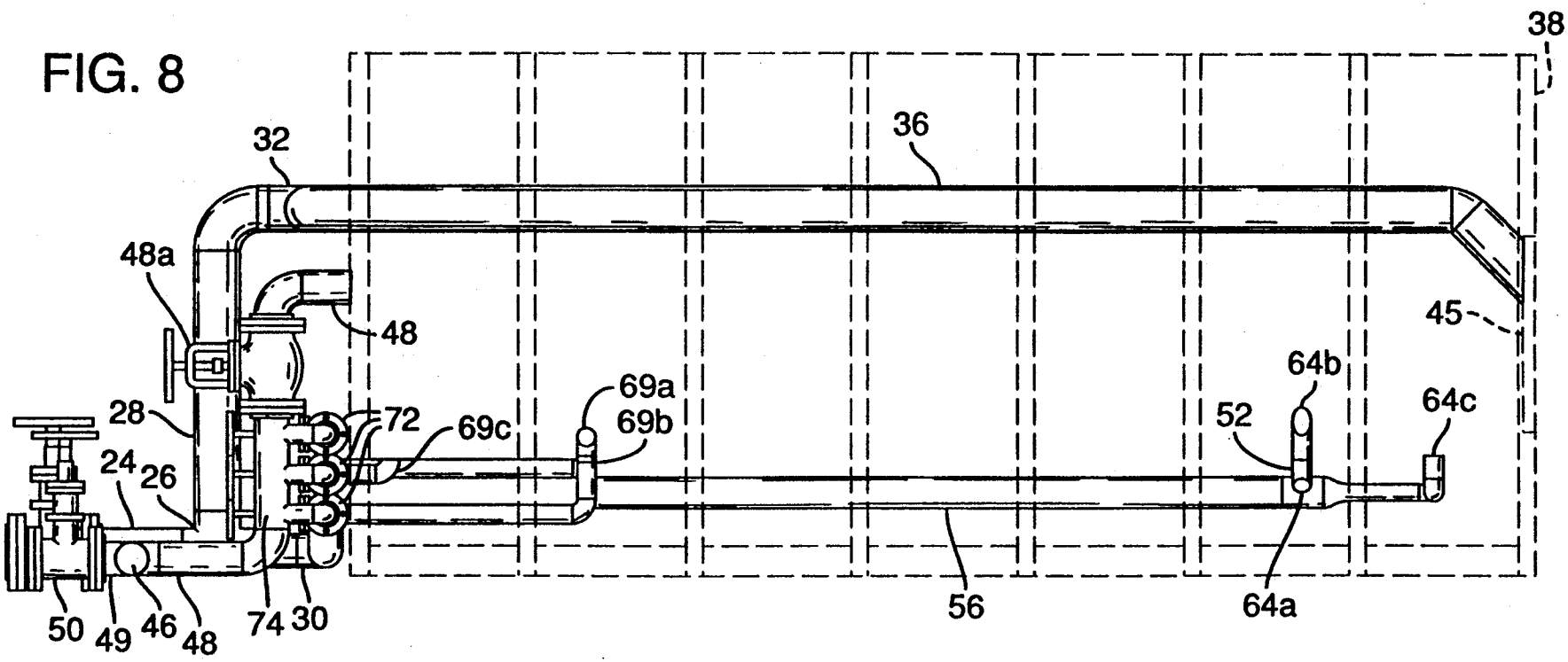
FIG. 8 is a schematic side view of the thermal fluid supply and return piping system.
Figure 9:
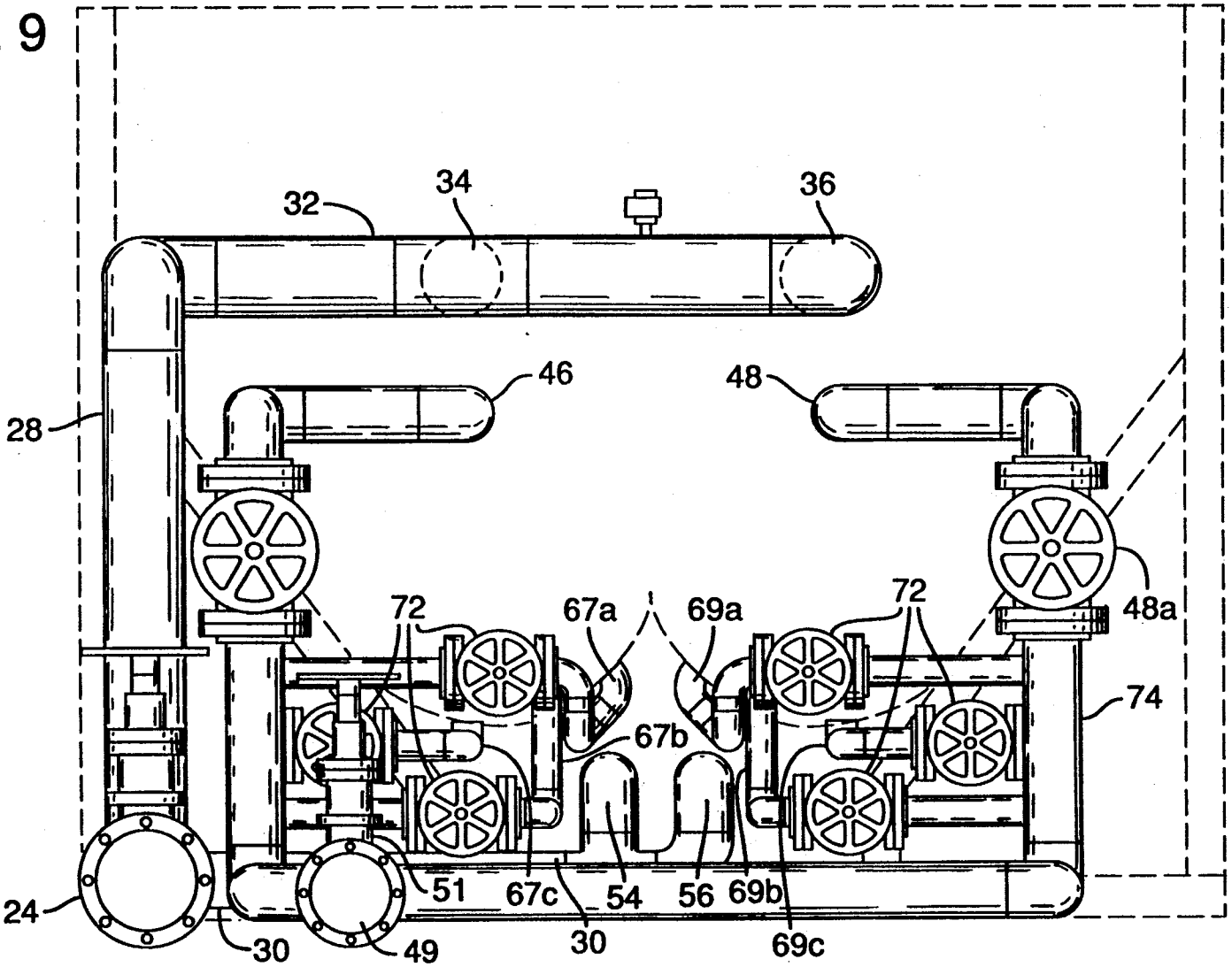
FIG. 9 is a schematic front end view of the thermal fluid supply and return piping system.

The portion of the heated thermal fluid directed into lower supply pipe 30 flows through trough supply pipes 54 and 56 to point 52 in the vicinity of rear wall 38. The thermal fluid is then directed into inner passages 45 of troughs 53 and 55 through two sets of three 2" pipes, designated 64*a–c* and 66*a–c* (FIG. 7). The thermal fluid flows forward through inner passages 45 of troughs 53 and 55. The fluid exits inner passages 45 of troughs 53 and 55 through outlet pipes 67*a–c* and 69*a–c*, which then join return pipes 46 and 48 respectively at manifolds 74. Globe valves 72 are mounted on each branch of manifolds 74 to regulate the flow of the returning fluid. By use of valves 72, 46*a* and 48*a*, thermal fluid flow through the inner passages 45 of all areas of hopper 22 can be readily adjusted to optimize heat distribution within hopper 22. After passing through manifolds 74, the returning oil flows through return lines 46 and 48 into return lines 49 and finally to boiler 20 for re-heating.

As described herein, system 10 can deliver 3,640 BTU's per square foot over a total contact surface area within the hopper of 91.7 square feet, which equates to 333,000 BTU's of energy. This is enough heat to melt 12 cubic yards of snow every 5 minutes at −40° F. The melting rate increases with increasing ambient temperature.

Referring to FIG. 3 and, once the thermal fluid is at operating temperature and circulating as described above, motor assemblies 65 (FIG. 5) are activated to rotate augers 62. Hopper 22 is then filled with a mixture of snow and solids by a front-end loader (not shown). Material screen 83 over hopper 22 rejects oversized materials contained in the snow to protect augers 62 from potential damage. The snow melts as it comes in contact with the heated pipes 34 and 36 within the hopper, sloped sides 40 and 42, and troughs 53 and 55. Sufficient snow mixture is added and melted to raise the slurry level in hopper 22 to approximately one foot from the top of hopper 22. The slurry is then heated to approximately 40°–50° F. The heated slurry then serves then be used as a direct contact heat source for melting subsequent loads of snow.

Figure 10:
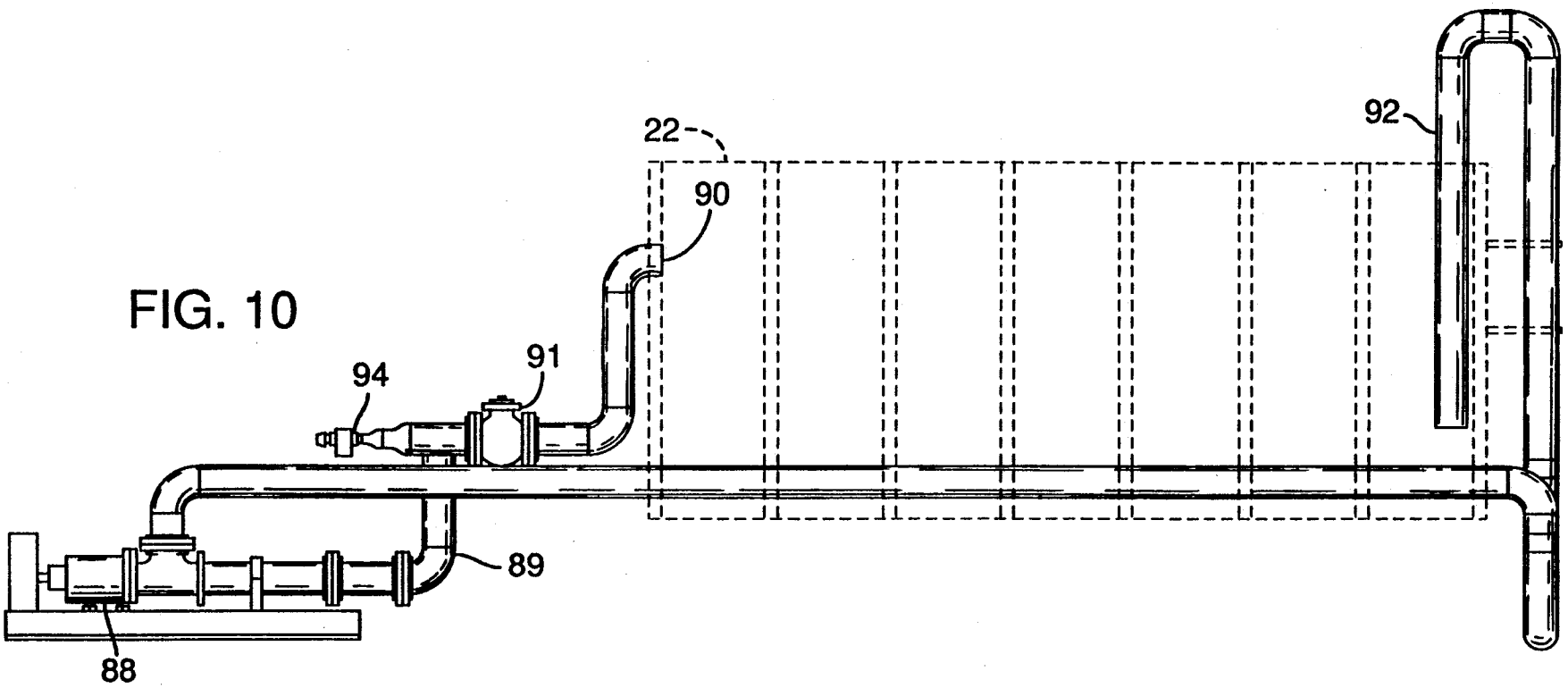
FIG. 10 is a side schematic view of the slurry circulation and discharge piping system.

As best seen in FIG. 10, the water recirculation/discharge system is then started. Water formed from the melted snow is drawn from hopper 22 through recirculation line 92 and into transfer pump 88. Transfer pump 88 is preferably a Berkeley Trash Pump. The water is then pumped through transfer pump discharge line 89, recirculation valve 91, and back into the front region of hopper 22 through port 90. Circulation of water in this manner serves to equalize the slurry temperature in hopper 22, and enhances heat transfer from the walls of hopper 22 to the slurry.

As more snow mixture is added and melted, the slurry level in hopper 22 reaches its maximum level. Recirculation valve 91 is then closed and discharge valve 94 is opened. Water is then discharged to a vacuum truck (not shown), or any suitable holding tank such as an Arctic tank or a Tiger Tank (not shown) for decontamination if required. Alternatively, if the melted snow is sufficiently clean, the liquid effluent can be pumped directly back onto the site.

Returning now to FIG. 3, as the melting process continues, solid materials contained in the snow mixture collect in the bottom portion of hopper 22, where they are continuously agitated and circulated by augers 62. When approximately 4 cubic yards has accumulated, accumulated liquid in hopper 22 is discharged through transfer pump 88 as described above. Tail end gate 80 (See FIG. 6) in rear wall 38 is opened and the solids are discharged from hopper 22 by the action of augers 62. Tail end gate 80 is a side-hinged door covering solids discharge port 82. The upper edge of port 82 is approximately the same elevation as rear bottom wall 43 to allow substantially complete removal of accumulated solids from the hopper. The solids are preferably discharged into a loader bucket (not shown). Tail end gate 80 is then closed, resealing solids discharge port 82, and the melting operation is resumed.

If contaminants such as crude oil, hydraulic oil, diesel fuel, or glycol are present in the snow mixture, they may be separated from the solids as well. In the preferred embodiment, a cleansing agent is added to the slurry in hopper 22 to dissolve the contaminants in the frozen snow mixture as the snow is melted, and thereby separate them from the solids. The continual agitation of the solids by the augers 62 promotes separation of the contaminants from the solids. The specific cleansing agent used will depend upon the particular spill or contaminant(s) in the snow mixture. The water/contaminant mixture discharged from hopper 22 is monitored and treated as required to comply with applicable environmental standards.

It will be understood by those skilled in the art that numerous modifications, substitutions, and detail changes may be made to the embodiments disclosed herein without departing from the spirit and scope of the following claims.

We claim:

1. A method for melting a snow mixture in an environment having an outside air temperature of not more than about −40° F., comprising the steps of:

providing a mixture of snow mixed with solids and chemical contaminants;

providing means for receiving a snow mixture comprising snow mixed with solids and chemical contaminants;

providing means in said receiving means for heating said snow mixture for melting said snow into water;

said receiving means being configured to gravitationally separate said solids from said water;

providing means within said receiving means for agitating said solids and water to separate said chemical contaminants from said solids for producing substantially decontaminated solids;

introducing a first quantity of said snow mixture into said means for receiving said snow mixture;

heating said first quantity of snow mixture, thereby melting snow therein and forming a first quantity of water within said receiving means;

heating said first quantity of water to a predetermined temperature;

introducing a second quantity of snow mixture into said heated first quantity of water within said receiving means, thereby melting the snow in said second quantity of snow mixture into a second quantity of water and separating to separate said solids therefrom;

and contacting said solids with said water with said means for agitating to separate said contaminants from said solids, thereby producing substantially decontaminated solids and water containing separated contaminants.

2. The method of claim 1, wherein the step of providing means for heating said snow includes providing a pipe within said receiving means.

3. The method of claim 2 wherein said step of providing snow heating means further includes providing a heated fluid within said pipe for indirectly transferring heat to said snow for melting said snow.

4. The method of claim 1 wherein said step of providing said snow heating means includes providing a wall, and further includes providing means defining an enclosed passageway within said wall.

5. The method of claim 4 wherein said step of providing said snow heating means further includes providing a heated fluid within said enclosed passageway for transferring heat through said wall for indirectly heating said snow.

6. The method of claim 1 wherein said step of providing said snow heating means includes the steps of:

providing a front wall, a side wall, and a rear wall;

providing means defining an enclosed passageway within each of said front wall, rear wall, and side wall; and providing means defining at least one continuous enclosed passageway in simultaneous communication with said enclosed passageways within said front wall, said rear wall, and said side wall.

7. The method of claim 6 wherein said step of providing said snow heating means further includes the step of providing a heated fluid within said continuous enclosed passageway for transferring heat through said front wall, said rear wall, and said side wall for indirectly heating said snow, snow mixed with solids, and snow containing contaminants.

8. The method of claim 1 wherein said step of providing heating means includes providing a fluid heated to a predetermined temperature for indirectly heating said snow for melting said snow.

9. The method of claim 8 wherein said step of providing a heated fluid includes providing a fluid heated to a temperature of at least about 350° F.

10. The method of claim 8 wherein said step of providing a heated fluid includes providing a fluid heated to a temperature of at least about 400° F.

11. The method of claim 8 wherein said step of providing a heated fluid includes providing a fluid heated to a temperature of at least about 500° F.

12. The method of claim 1 which further comprises the step of discharging said decontaminated solids.

13. The method of claim 1 which further comprises the step of discharging said water for further decontamination.

14. The method of claim 1 which further comprises the step of discharging a portion of said first and second quantities of water from said receiving means.

15. The method of claim 1 which further comprises the step of discharging said water containing separated contaminants from said receiving means, and collecting said water containing separated contaminants in a second receiving means.

16. The method of claim 1 which further comprises the step of discharging said decontaminated solids while isolating said water containing separated contaminants from a surrounding environment.

17. The method of claim 1 which further comprises the step of discharging a portion of said first and second quantities of water from said receiving means while isolating said portion from a surrounding environment.

18. The method of claim 1 which further comprises the step of collecting said water containing separated contaminants in a lower portion of the receiving means, and discharging said water containing separated contaminants from the receiving means while isolating said water containing separated contaminants from a surrounding environment.

19. The method of claim 1 which comprises the step of moving said means for receiving said snow, snow mixed with solids and snow which contains contaminants, said means for heating said snow for melting said snow into water, and said means for agitating, to a plurality of locations within a surrounding environment.

20. The method of claim 1 which further comprises heating said first quantity of water to a temperature of at least about 50° F. for melting said second quantity of snow mixture into water.

21. The method of claim 1 wherein said snow heating and melting step includes heating and melting at least 100 cubic yards of snow per hour.

22. The method of claim 1 wherein the step of providing means for receiving a snow mixture includes the step of providing a hopper comprising and inner wall and an outer wall, the inner and outer walls defining an enclosed channel, and wherein the steps of heating said first quantity of snow mixture and said first quantity of water include the step of directing a heated fluid through the enclosed channel.

23. A method for melting snow in an environment having an outside air temperature of not more than about −40° F., snow which is mixed with solids, and snow which contains contaminants, comprising the steps of:

providing a mixture of snow mixed with solids and chemical contaminants;

providing a hopper for receiving said snow, snow which is mixed with solids and snow which contains contaminants;

providing a heating system disposed within said hopper for melting said snow into water;

providing a mechanical agitating system disposed within a lower portion of said hopper for said solids with said water to separate said contaminants from said solids;

introducing said snow, snow mixed with solids and snow which contains contaminants into said hopper;

heating said snow in said hopper to a temperature which will melt said snow and form water; and contacting said solids with said water to separate said contaminants from said solids with said mechanical agitating system thereby producing substantially decontaminated solids.

* * * * *